US010973282B2

(12) United States Patent
Satchell et al.

(10) Patent No.: US 10,973,282 B2
(45) Date of Patent: Apr. 13, 2021

(54) MATERIAL FOR DEVELOPING/MAINTAINING OR COMPENSATING FOR MOTOR SKILLS

(71) Applicants: Charisse Satchell, East Orange, NJ (US); Elise Bourne-Busby, Passaic, NJ (US); Ethel Edwards, Passaic, NJ (US)

(72) Inventors: Charisse Satchell, East Orange, NJ (US); Elise Bourne-Busby, Passaic, NJ (US); Ethel Edwards, Passaic, NJ (US)

( * ) Notice: Subject to any disclaimer, the term of this patent is extended or adjusted under 35 U.S.C. 154(b) by 0 days.

(21) Appl. No.: 16/397,681

(22) Filed: Apr. 29, 2019

(65) Prior Publication Data

US 2019/0246744 A1 Aug. 15, 2019

Related U.S. Application Data

(63) Continuation-in-part of application No. 15/486,812, filed on Apr. 13, 2017, now Pat. No. 10,314,366.

(60) Provisional application No. 62/321,778, filed on Apr. 13, 2016.

(51) Int. Cl.
*A43C 1/02* (2006.01)
*A43C 9/00* (2006.01)

(52) U.S. Cl.
CPC ..... *A43C 9/00* (2013.01)

(58) Field of Classification Search
CPC ..... A43C 1/02
See application file for complete search history.

(56) References Cited

U.S. PATENT DOCUMENTS 579,943 A 3/1897 Kernpshall
943,607 A * 12/1909 Schelling ..... A43C 1/02 24/715.3
1,770,786 A * 7/1930 Kohler ..... A43C 1/02 24/715.3
1,853,551 A * 4/1932 Crimmins ..... D02G 3/32 57/225
1,853,666 A * 4/1932 Crimmins ..... D02G 3/32 66/190
1,948,844 A * 2/1934 Dawes ..... A43C 1/02 24/715.3
2,477,151 A * 7/1949 Stapleton ..... A43C 9/00 24/713
2,646,630 A 7/1953 Miller
2,887,005 A * 5/1959 Fromm ..... A43C 1/02 87/1
3,566,481 A 3/1971 Causer
3,683,520 A 8/1972 Partagas
4,423,539 A * 1/1984 Ivanhoe ..... A43C 1/02 24/715.3
4,426,756 A 1/1984 Herdman
4,637,798 A 1/1987 Maiden-Nesset
4,721,468 A 1/1988 Alexander et al.
4,842,522 A 6/1989 Alexander et al.
(Continued)

*Primary Examiner* — Jason W San
(74) *Attorney, Agent, or Firm* — Gearhart Law LLC

(57) ABSTRACT

Described herein is a flexible but resilient material comprising a soft outside shell and an internal flexible but resilient support core, as well as a method for constructing such a flexible but resilient material that can have multiple applications, including being used to manufacture an improved wearable apparatus to help young children, individuals who are physically challenged, and/or who have a limiting physical disability.

19 Claims, 4 Drawing Sheets

(56) References Cited

U.S. PATENT DOCUMENTS 4,858,282 A * 8/1989 DuPont, Jr. ..... A43C 9/00 24/712
5,029,372 A * 7/1991 Brinson ..... A43C 9/00 24/715.4
5,209,667 A 5/1993 Stanfield
5,540,154 A * 7/1996 Wilcox ..... C06C 5/00 102/275.1
5,557,864 A * 9/1996 Marks ..... A43C 11/00 24/306
5,562,457 A 10/1996 Haslam
5,639,244 A 6/1997 Stricklin
5,673,546 A * 10/1997 Abraham ..... A43C 9/00 24/713
5,897,323 A 4/1999 Stanfield
5,918,352 A 7/1999 Galbreath
6,014,794 A * 1/2000 Me Coy ..... B62J 7/08 24/265 H
6,140,589 A * 10/2000 Blackmore ..... H01B 7/0009 174/128.1
6,179,178 B1 * 1/2001 Stegmeyer ..... A45C 13/30 224/257
6,247,359 B1 * 6/2001 De Angelis ..... D07B 1/14 73/158
6,283,004 B1 * 9/2001 Tseng ..... D04C 1/12 87/6
6,382,981 B1 5/2002 Stanfield
6,397,854 B1 6/2002 Bailey
6,729,784 B2 5/2004 Gioffre
6,761,654 B2 * 7/2004 Murphy ..... A63B 41/085 473/596
6,964,625 B2 * 11/2005 Murphy ..... A63B 41/085 24/712
7,036,194 B2 5/2006 Tricker
7,309,235 B2 12/2007 Wilk
7,549,201 B2 6/2009 Kraft et al.
7,713,062 B2 5/2010 Welling
8,272,110 B2 9/2012 Valenzuela
9,084,918 B2 * 7/2015 McNamee ..... A63B 41/08
D785,108 S * 4/2017 Wagner ..... D21/712
D793,716 S * 8/2017 Littleton ..... D3/205
10,207,659 B2 * 2/2019 Ohgushi ..... B60R 16/0215
10,314,366 B2 6/2019 Torres et al.
2002/0100150 A1 * 8/2002 Gioffre ..... A43C 7/02 24/712
2003/0097104 A1 * 5/2003 Gilbert ..... A61F 13/2051 604/370
2003/0097108 A1 * 5/2003 Hasse ..... A61F 13/2068 604/379
2003/0097112 A1 * 5/2003 Gilbert ..... A61F 13/2051 604/385.17
2006/0024651 A1 2/2006 Davis
2006/0088809 A1 4/2006 Blake et al.
2007/0044992 A1 * 3/2007 Bremnes ..... H01B 7/183 174/102 R
2008/0086854 A1 * 4/2008 Boyd ..... A61B 17/064 24/715.3
2011/0047822 A1 * 3/2011 Pape ..... A43B 1/0063 36/51
2011/0195268 A1 * 8/2011 Schaffer ..... A43C 9/00 428/600
2012/0144631 A1 * 6/2012 Stanev ..... A43C 1/02 24/715.3
2012/0198668 A1 8/2012 Butler
2013/0117975 A1 5/2013 Herrera
2013/0255045 A1 * 10/2013 Gonzalez ..... A43C 9/00 24/715.3
2014/0208615 A1 * 7/2014 Teifer ..... A43C 11/002 36/51
2014/0308641 A1 10/2014 Tebben et al.
2015/0230559 A1 * 8/2015 Facer ..... A43C 9/00 24/715.7
2017/0318907 A1 * 11/2017 Creton ..... A43C 1/02
2017/0367442 A1 * 12/2017 Tsai ..... A43C 9/02
2019/0104909 A1 * 4/2019 Policicchio ..... A47L 13/38

* cited by examiner

MATERIAL FOR DEVELOPING/MAINTAINING OR COMPENSATING FOR MOTOR SKILLS

CLAIM OF PRIORITY

This application claims priority to U.S. patent application Ser. No. 15/486,812, filed on Apr. 13, 2017, which claims priority to U.S. Application 62/321,778 filed on Apr. 13, 2016, the contents of which are herein fully incorporated by reference in its entirety.

FIELD OF THE EMBODIMENTS

The embodiments of the present invention generally relate to a flexible but resilient material and its application in constructing a shoelace and other materials that are capable of retaining a desired shape to help and facilitate development/maintenance motor skills, and/or compensation for motor skill deficits.

BACKGROUND OF THE EMBODIMENTS

Regular shoelaces are commonly comprised of a soft center core and a tube of braided fabric covered on the periphery of the center core. While flexible, such shoelaces, however, may be problematic to certain wearers (e.g., young children, persons who have physical disabilities, or who are physically challenged) in that they may have a difficult time in tying the shoelace up into a particularly shaped (e.g., a bow) knot and further in tightening the shoelace sufficiently to prevent such a knotted shoelace tie from becoming loose or untied during wearing. Over the years, there have been efforts devoted to constructing an improved shoelace in addressing such problems.

REVIEW OF RELATED TECHNOLOGY

U.S. Pat. No. 8,272,110 pertains to an improved shoelace comprised of a plurality of bendable support elements permanently held within a limp material at each of the two end tips by a sleeve, where the bendable supports can be wires of certain thickness made of copper, steel, aluminum, alloy, or any combination thereof and coated in plastic.

U.S. Pat. No. 6,729,784 pertains to a method for inhibiting the loosening of knotted ties, e.g., shoelaces, by applying to the ties a waxy compound comprising a waxy ingredient effective to inhibit the ties from becoming untied.

U.S. Pat. No. 5,209,667 pertains to a shoelace for use by young children or the handicapped, which facilitates tying of a bow by providing a moderately stiff end portion; the stiff end portion can retain a loop shape when a pair of spaced locations on the stiff end portion are temporarily fastened together as by a pair of Velcro® retainers. The shoelace is formed of a flexible shoelace core with first and second opposite end portions, and with the first end portion penetrated by a solidified, originally-liquid stiffening material.

None of the art described above addresses all of the issues that the present invention does. Accordingly, there is a long-felt need for an improved shoelace that can be used easily by children, persons who are physically challenged, and/or with physical disabilities, to tie their shoes. There is also a need for an improved shoelace that does not contain metals or other materials that may pose potential hazards.

SUMMARY OF THE EMBODIMENTS

An embodiment of the present invention relates to a length of a flexible but resilient material comprising: an outside shell. A sheath is encased in the outside shell. Support element cores are encased in the sheath.

Another embodiment of the present invention relates to a wearable apparatus comprising piece(s) of fabric and a lace. The lace may include an outside shell. An adhesive film sleeve is encased in the outside shell. A sheath is encased in the adhesive film. Support element core(s) are encased in the sheath. The lace also includes a wax coating compound. The support element core(s) are coated with the wax coating compound. Furthermore, the lace includes first and second ends that are each capped by an end-cap. In addition, the lace fasten(s) the pieces of fabric together.

The adhesive film sleeve can be made of a plant based or synthetic resin compound.

In both of the above embodiments, the support element core may be made of a soft and flexible material selected from the group consisting of, but not limited to, wool, cotton, acrylic, fabric, and/or any combination thereof, said sheath is made of a material of, but not limited to, wool, cotton, acrylic, synthetic fabric, satin, silk, cloth, paper products of different types comprising: single or multiple ply paper, laminated paper, crepe paper, self-sticking paper and/or any combination thereof while said outside shell may be made of a limp material selected from the group consisting of, but not limited to, wool, cotton, synthetic fabric, cloth, suede, nylon, leather, and/or any combination thereof.

It is an object of at least one embodiment of the present invention to provide a method of helping young children, the physically challenged or individuals who have physical disabilities in easily tying their shoelaces and/or learning to tie.

It is another object of at least one embodiment of the present invention to provide a method for constructing a flexible but resilient material that can have multiple applications.

It is another object of at least one embodiment of the present invention to provide a wax compound that can help to form and maintain the shape and appearance of a shoelace knot.

It is another object of at least one embodiment of the present invention to provide a shoelace with a flexible but resilient element core(s)/sheath/adhesive film/outside shell structure, wherein the flexible but resilient support core element(s) are coated with a wax compound.

It is another object of at least one embodiment of the present invention to provide a material that it is inexpensive and easy to use.

It is another object of at least one embodiment of the present invention to provide a material that can have multiple potential applications in various fields.

DESCRIPTION OF THE PREFERRED EMBODIMENTS

Figure 1A:
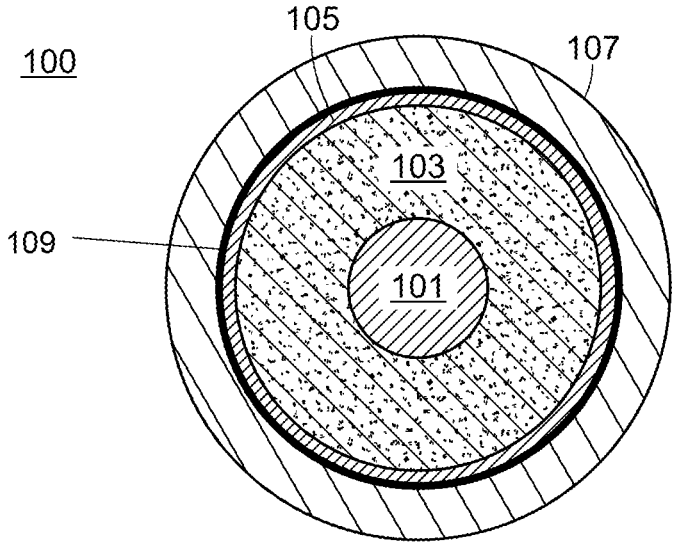
FIG. 1A shows a cross-sectional view of an embodiment of the invention.

The preferred embodiments of the present invention will now be described with reference to the drawings. Identical elements in the various figures are identified with the same reference numerals.

Reference will now be made in detail to each embodiment of the present invention. Such embodiments are provided by way of explanation of the present invention, which is not intended to be limited thereto. In fact, those of ordinary skill in the art may appreciate upon reading the present specification and viewing the present drawings that various modifications and variations can be made thereto.

Figure 1B:
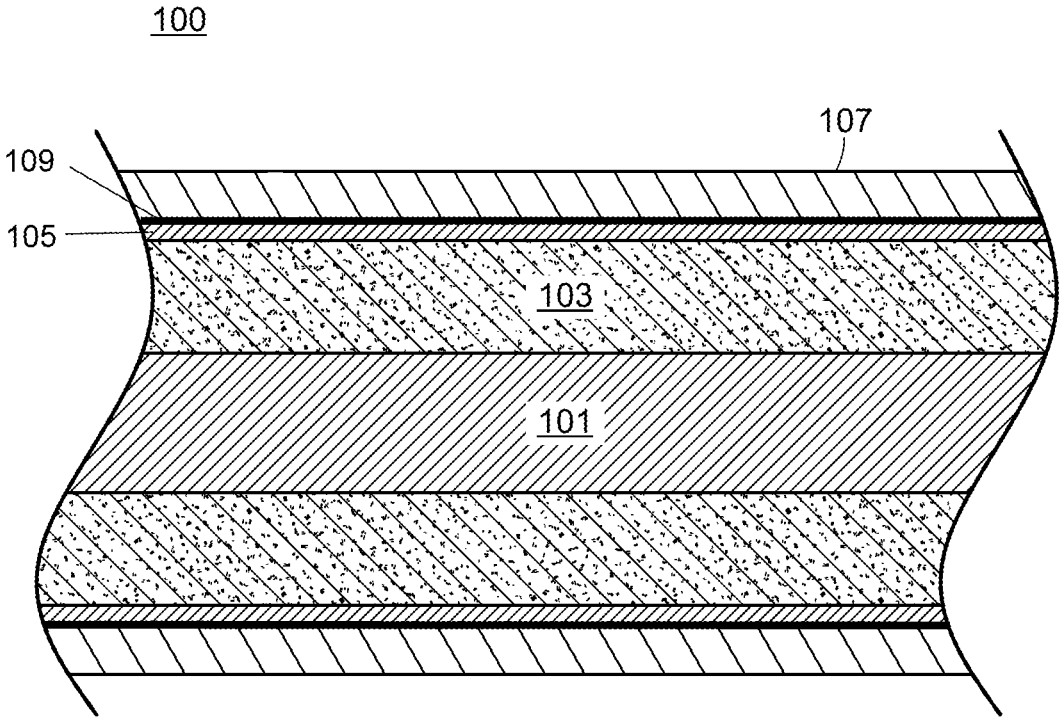
FIG. 1B shows a cut-away view of a part of an embodiment of the invention.

Referring now to FIGS. 1A and 1B, FIG. 1A illustrates a cross-sectional view of a preferred embodiment 100 of the present invention of a length of a flexible but resilient material comprising: a bendable support assembly, which comprises at least one bendable support element comprising a support element core 101 coated with a wax coating compound 103. This bendable support assembly is encased in a sheath 105, which is, in turn, encased in an adhesive film sleeve 109, which is, further in turn, encased in an outside shell 107. FIG. 1B illustrates a cut-away view (along the length) of the same preferred embodiment 100. A pre-selected length of said flexible but resilient material comprises a first end and a second end and each of said ends are crimped, capped by a plastic end-cap tubing or metal/plastic aglet.

Figure 2A:
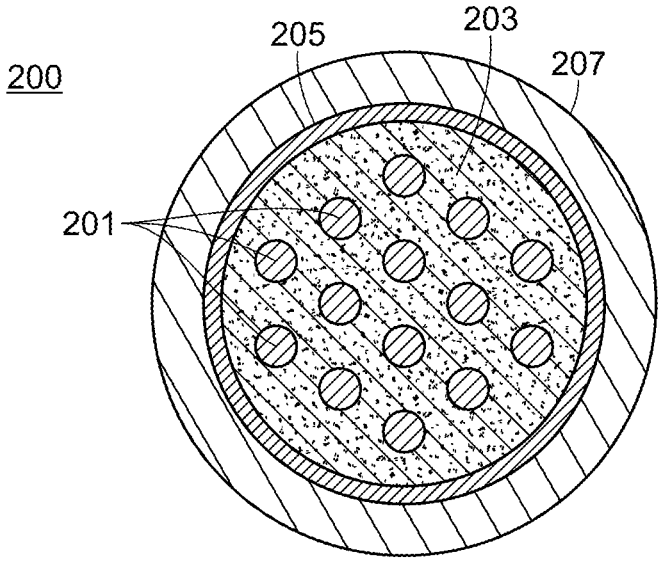
FIG. 2A shows a cross-sectional view of another embodiment of the invention.
Figure 2B:
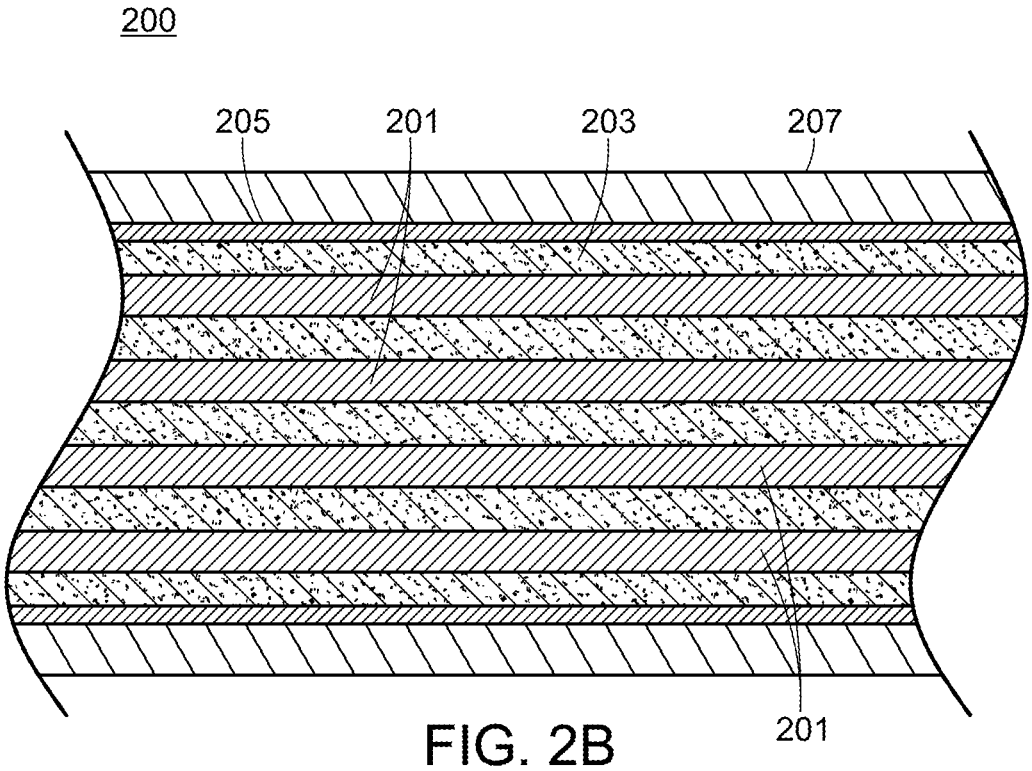
FIG. 2B shows a cut-away view of a part of another embodiment of the invention.

Referring now to FIGS. 2A and 2B, FIG. 2A illustrates a cross-sectional view of another preferred embodiment 200 of the present invention of a length of a flexible but resilient material comprising: a bendable support assembly, which comprises more than one bendable support element that is arranged to have a center support element core with multiple surrounding support element cores 201 and said bendable support assembly is coated with said wax compound 203. Multiple, rather than a single, support elements are preferable because their combination provides increased strength and rigidity. This bendable support assembly is encased in a sheath 205, which is, in turn, may be encased in an adhesive film sleeve 109 (see FIG. 1), which is, further in turn, encased in an outside shell 207. FIG. 2B illustrates a cut-away view (along the length) of the same preferred embodiments 200. A pre-selected length of said flexible but resilient material comprises a first end and a second end and each of said ends is crimped, capped by a plastic end-cap tubing or metal/plastic aglet.

Figure 3A:
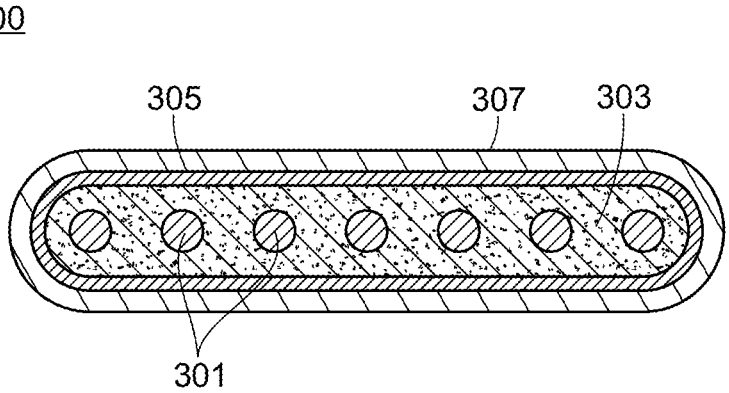
FIG. 3A shows a cross-sectional view of yet another embodiment of the invention.
Figure 3B:
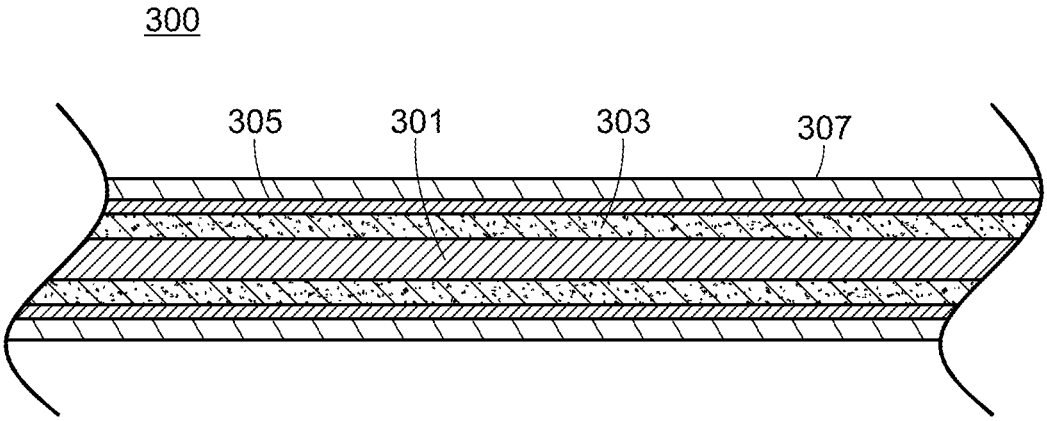
FIG. 3B shows a cut-away view of a part of yet another embodiment of the invention.

Referring now to FIGS. 3A and 3B, FIG. 3A illustrates a cross-sectional view of yet another preferred embodiment 300 of the present invention of a length of a flexible but resilient material comprising: a bendable support assembly, which comprises more than one bendable support element arranged to have said multiple support element cores 301 evenly spaced to each other and said bendable support assembly is coated with said wax compound 303. Multiple, rather than a single, support elements are preferable because their combination provides increased strength and rigidity. This bendable support assembly is encased in a sheath 305, which, in turn, may be encased in an adhesive film sleeve 109 (see FIG. 1), which is, further in turn, encased in an outside shell 307. FIG. 3B illustrates a cut-away view (along the length) of the same preferred embodiments 300. A pre-selected length of said flexible but resilient material comprises a first end and a second end and each of said ends is crimped, capped by a plastic end-cap tubing or metal/plastic aglet.

Figure 4:
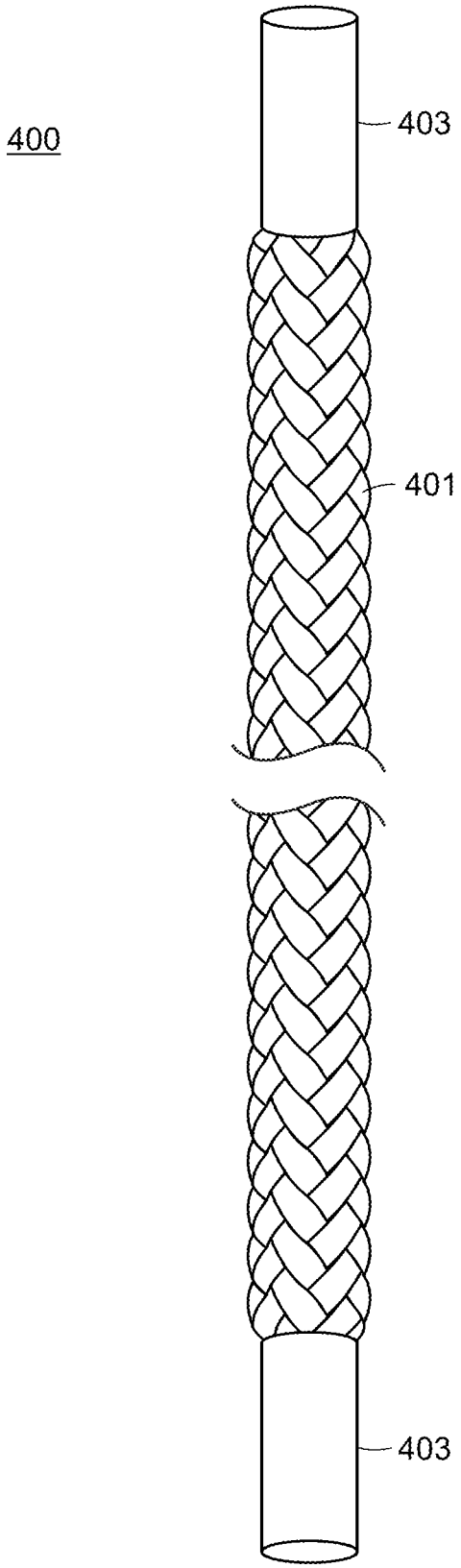
FIG. 4 shows a perspective view of an embodiment of the invention.

Turning now to FIG. 4, there is a perspective view of yet another preferred embodiment 400 of the present invention of a shoelace 401 made of a pre-selected length of a flexible but resilient material comprising: an outside shell; an adhesive film sleeve; a sheath; a bendable support assembly, which comprises at least one bendable support element comprising a support element core coated with a wax coating compound, or more than one bendable support element, that may be arranged in various ways, such as, with an even-spacing among them, or having a center support element core that is surrounded by multiple support element cores with an even-spacing, etc. and said bendable support assembly is coated with said wax compound. Here, the bendable support assembly is encased in said sheath, which in turn may be encased in an adhesive film sleeve, which is, further in turn encased in said outside shell. A pre-selected length of said flexible but resilient material comprises a first end and a second end and each of said ends is secured by a plastic end-cap tubing 403, or metal/plastic aglet, or by crimping.

A variety of materials are contemplated as being suitable for constructing all of the above-mentioned embodiments. For example, said bendable support element core may be made of a soft and flexible material selected from the group consisting of, but not limited to, wool, cotton, acrylic, fabric, and/or any combination thereof, while said sheath may be a material made of, but not limited to wool, cotton, acrylic, synthetic fabric, satin, silk, cloth, paper products of different types comprising: single or multiple ply paper, laminated paper, crepe paper, self-sticking paper and/or any combination thereof. Additionally, it is contemplated that the outside shell may be made of a limp material selected from the group consisting of, but not limited to, wool, cotton, synthetic fabric, cloth, suede, nylon, leather, and/or any combination thereof, i.e., materials typically utilized in constructing a shoelace.

The cross section of the shoelace according to the preferred embodiment shown in FIG. 4 is either cylindrical or rectangular in shape, wherein the wax compound coating the support element core includes organic and/or inorganic materials of laminating or food grade. The composition of such wax compound contains a waxy ingredient that is naturally occurring or synthetic. The thickness of said wax compound coating on the bendable support element core is about 0.1 to about 10 millimeters and about 5 to about 30 percent by weight based on the total combined weight of the bendable support element.

An example of another embodiment may include a length of a flexible and resilient material for a lace. An example of the lace may include a compound string used to fasten components of a wearable apparatus.

The flexible and resilient material (100, 200, or 300) may include an outside shell (107, 207, or 307. A sheath (105, 205, or 305) may be encased by the outside shell. Support element core(s) (101, 201, or 301) may be encased in the sheath.

A water insoluble material may coat the support element core(s) (within the sheath). The water insoluble material may include an organic material or an inorganic material. The organic material may include animal and/or plant based waxes. The inorganic material may include mineral and/or petroleum based waxes. The water insoluble material may include a wax compound (103, 203, or 303). The wax compound may include organic and/or inorganic materials. The adhesive sleeve may be water resistant or the sheath may be water resistant.

The lace may be a shoelace. The material may include first and second ends. Each of the first and second ends may be capped by an end-cap.

In an example scenario, a diameter of the outside shell may be ⅜ inches. A diameter of the outside shell may also be ¼ inches. A diameter of the sheath may be less than the diameter of the outside shell. A diameter of the support element core(s) may be less than the diameter of the sheath.

In another example scenario, a length of the material may be equal or less than 45 inches. In yet another example scenario, the length of the material may be more than 45 inches.

Another example of an embodiment may include a wearable apparatus. The wearable apparatus may include a piece(s) of fabric and a lace (or a compound string). The lace (or the compound string) may include an outside shell. An adhesive film sleeve may be encased in the outside shell. A sheath may be encased in the adhesive film. The support element core(s) may be encased in the sheath. The lace (or the compound string) may include a wax coating compound. The support element core(s) may be coated with the wax coating compound (within the sheath). The lace may also include first and second ends that are each capped by an end-cap. Furthermore, the lace may fasten a piece(s) of fabric together.

In an example scenario, the lace (or compound string) may include a shoelace. The adhesive sleeve may be water resistant. The adhesive sleeve may be coated with a water repellent polymer to generate the water resistant attribute of the lace. The lace may also be washable with soap, and/or water, among other chemicals. The lace may be resistant to a damage associated with a wash cycle and/or hand washing. As such, the lace may maintain original (manufactured) properties after being subjected to a number of wash cycles and/or hand washes.

EXAMPLE

In the example described below, the following components, materials and manufacturing procedural steps, as summarized in the Table, were used, unless otherwise noted:

Method Utilized To Manufacture One Small Batch of Laces Comprising of about 5 Units

| Components | Material/Makeup | Specifications/Quantity | Procedure |
|---|---|---|---|
| Internal Bendable Support Core/Element | 5 strands of cotton/acrylic blend yarn | Each measuring about ¼ inch wide and 45 inches long | 1. Cut yarn to 45 inches in length |
| Waxy Compound | 1. Inorganic/organic wax pastilles | A total of about 2 ounces/60 grams was used per batch | 2. Melt wax pastilles and wax adhesive additive at a temperature of about 85 degrees F. |
| | 2. Inorganic/organic wax adhesive compound | about .5 ounces | 3. Rest yarn in wax bath for up to 5 minutes<br>4. Remove strands and allow to dry on a nonstick surface for up to 10 minutes or until solid and assembly comes to a temperature near or at room temperature |
| Inner Sheath | 5 pieces of Polyester blend ribbon or crepe paper | Each measuring about ⅜ of an inch wide and 45 inches long | 5. Cut ribbon or paper to 45 inches in length<br>6. Press along the length of the support assembly to adhere |
| Adhesive layer | 5 strips of adhesive | Each measuring about ⅜ of an inch wide and 45 inches long | 7. Cut adhesive strip to 45 inches in length<br>8. Press along the length of the support assembly to adhere |
| Outer Shell | 5 polyester blend outer shells/hollow shoelace strings | Each measuring about ¼ inch in wide and 45 inches long | 9. Support assembly covered in sheath and/or adhesive is threaded through outer shell |
| End-cap/Securing Element | 1. 10 metal aglets | Each piece measures about 1 inch in length | 10. Affix aglets to both ends of each completed lace<br>Or |
| | 2. 10 pieces of heat shrink tubing | Each piece measuring about 1 inch in length and 3/16 of an inch in diameter | 10. Cut heat shrink tubing to 1 inch in length and slide over ends<br>11. Heat to shrink tubing around assembly ends |

As described in the table above, the present invention, in some embodiments, may be manufactured by first using an internal bendable support/core element that is made of a strand of cotton/acrylic blend yarn that measures about ¼ of an inch wide or less and about 45 inches long.

The yarn may then coated by a waxy compound by placing it in a warm wax bath made of wax that includes inorganic/organic pastilles measuring at least 12 grams in weight and 0.5 ounces of a wax adhesive additive and melted at a temperature of about 85 degrees Fahrenheit.

After soaking for up to 5 minutes, the yarn may be removed and allowed to dry for up to 10 minutes to a temperature near or at room temperature or until it forms the solid support assembly. The solid wax coated support assembly is then covered by an inner sheath made of a polyester blend fabric measuring about ⅜ of an inch wide and about 45 inches long that is pressed along the length of the solid support assembly until it adheres. Alternative materials for the inner sheath include paper products of different types comprising: single or multiple ply paper, laminated paper, crepe paper, self-sticking paper.

The assembly with its affixed inner sheath may then be encased by an adhesive film sleeve, which may then be further encased by an outer shell made of a hollow, tubular, braided polyester fabric blend measuring about ½ of an inch in diameter and about 45 inches in length. The ends of the resulting flexible, resilient embodiment may then be finally secured by slipping on an end cap made of a cylindrical piece of tubing measuring about 1 inch in length and about 3/16 of an inch in diameter that is heated until it shrinks to about half of its original diameter, resulting in a close wrapping effect around the assembly's ends or by crimping metal aglets measuring about 1 inch in length around the assembly's ends.

The many elements of the present invention make it unique in the field. The novelty is illustrated by the various options for nearly every aspect of the invention that allow it to be used in a variety of additional embodiments and further by adding or deleting several core units and affixing them between different types of fabrics/materials.

In one such embodiment to be used in garments and/or under garments, the material of the present invention can be used to replace drawstrings, ties, or wire found in various products including, but not limited to, hoodies, jackets, corset/waist trainers, scrub uniform pants, bras, men's ties/bows, drawstring backpack, etc.

In another such embodiment, the material of the present invention can be used to manufacture hair ties, or the substructures/components/supports used in common items including, but not limited to, bag handles, brims of hats, etc.

In yet another such embodiment, the material of the present invention can be used to replace the string/ties/rope used in the following skill building activities, including, but not limited to, boy scouts knot tying, weaving mats, string used in a stringing bead set for children, knot tying games, shoelace tying books, etc.

In still another such embodiment, the material of the present invention can be used to form a core panel in the following products for special needs children, including, but not limited to, weighted vests, weighted blankets, weighted bean bags, yoga mats, etc.

Although this invention has been described with a certain degree of particularity, it is to be understood that the present disclosure has been made only by way of illustration and that numerous changes in the details of construction and arrangement of parts may be resorted to without departing from the spirit and the scope of the invention.

What is claimed is:

1. A lace for an article of footwear, the lace comprising:
an outside shell;
an adhesive coupled to the outside shell;
a sheath encased in and coupled to the outside shell and the adhesive; one or more support element cores encased in the sheath;
a wax coating compound coating each of the one or more support element cores, wherein the wax coating compound is insoluble in water;
a first end and a second end, wherein the first end and the second end are each capped by an end-cap; and
wherein the lace is configured to couple one or more components of the article of footwear together.

2. The lace of claim 1, wherein the end-cap is comprised of plastic or metal.

3. The lace of claim 1, wherein a diameter of the outside shell is about ⅜ inches.

4. The lace of claim 1, wherein a diameter of the outside shell is about ¼ inches.

5. The lace of claim 1, wherein a length of the material is equal to or less than 45 inches.

6. The lace of claim 1, wherein a length of the material is more than 45 inches.

7. A wearable apparatus comprising:
one or more pieces of fabric; and
a lace comprising:
an outside shell;
an adhesive film sleeve encased in the outside shell;
a sheath encased in the adhesive film;
one or more support element cores encased in the sheath;
a wax coating compound, the wax coating compound coating each of the one or more support element cores,
wherein the wax coating compound is insoluble in water; and
a first end and a second end,
wherein the first end and the second end are each capped by an end-cap;
and wherein the lace fastens the one or more pieces of fabric together.

8. The wearable apparatus of claim 7, wherein the lace is a shoelace.

9. The wearable apparatus of claim 7, the adhesive film sleeve is water resistant.

10. The wearable apparatus of claim 7, wherein the lace is washable.

11. The wearable apparatus of claim 10, wherein the lace is resistant to damage associated with a wash cycle or a hand wash.

12. The lace of claim 1 wherein the wax coating compound comprises a wax compound and a wax adhesive compound.

13. The lace of claim 1 wherein the adhesive material is encased by the outer shell.

14. The wearable apparatus of claim 7 wherein the wax coating compound comprises a wax compound and a wax adhesive compound.

15. The lace of claim 1 wherein the adhesive material is directly adhered to the outer shell.

16. The lace of claim 1 wherein the sheath is encased by an adhesive material.

17. The lace of claim 13 wherein the adhesive material is disposed along a length of the wax coating compound.

18. The lace of claim 1 wherein the one or more support cores comprises a blend of cotton and acrylic.

19. The lace of claim 1 wherein the sheath is a polyester based material.

* * * * *